US005217488A

United States Patent [19]

Wu

[11] Patent Number: 5,217,488

[45] Date of Patent: Jun. 8, 1993

[54] MOTOR-OPERATED TRACTION DEVICE

[76] Inventor: Kuang-Hsing Wu, No. 294, Sec. 3, Hsin Lung Rd., Taipe, Taiwan

[21] Appl. No.: 932,676

[22] Filed: Aug. 20, 1992

[51] Int. Cl.[5] ..... A61H 1/02

[52] U.S. Cl. ..... 606/241; 602/32; 606/243

[58] Field of Search ..... 602/32, 33, 35, 36, 602/40; 606/237, 241-245; 128/75, 78; 5/83.1, 646-651

[56] References Cited

U.S. PATENT DOCUMENTS

| | | | |
|---|---|---|---|
| 2,502,752 | 4/1950 | Richards | 5/648 |
| 2,773,499 | 12/1955 | Nieden | 602/32 |
| 4,602,619 | 7/1986 | Wolf et al. | 606/241 |

*Primary Examiner*—Richard J. Apley
*Assistant Examiner*—J. Mollo
*Attorney, Agent, or Firm*—Varndell Legal Group

[57] ABSTRACT

A motor-operated traction device includes an actuator consisting of a DC motor and a worm shaft assembly and controlled by a controller to reciprocate a rocker arm causing a horizontal pull rod to pull a waist harness and a neck harness so as to apply traction to the patient's spine.

1 Claim, 6 Drawing Sheets

MOTOR-OPERATED TRACTION DEVICE

BACKGROUND OF THE INVENTION

The present invention relates to traction devices and relates more particularly to a motor-operated traction device which is driven by a DC motor to automatically apply traction to the patient lying on the folding bed thereof.

Various traction devices are known and widely in use for applying traction to patients. Different traction devices may be used in different locations for different purposes. Most traction devices are expensive and to be employed in hospitals. Examples of traction devices may be found in U.S. Pat. Nos. 1,356,365; 4,114,611 and 3,662,750. These traction devices are commonly operated by labor and have no bed for letting a patient lie comfortably in. Therefore, these traction devices are neither convenient nor comfortable in use, and an attendant or nurse may be needed to operate a traction device in applying traction to a seriously sick patient.

SUMMARY OF THE INVENTION

The present invention eliminates the aforesaid disadvantages. It is therefore an object of the present invention to provide a motor-operated traction device which operates automatically by means of a controller. It is another object of the present invention to provide a motor-operated traction device which has a bed for letting the patient lie in to be treated comfortably. It is still another object of the present invention to provide a motor-operated traction device which can be collapsed to minimize storage space when it is not in use. It is still another object of the present invention to provide a motor-operated traction device which is safe in use.

In the preferred embodiment, the traction device comprises a lying bed for a patient, an actuator, a rocker arm driven by the actuator to reciprocate a horizontal pull rod, and harnesses hung on the the horizontal pull rod and adapted to be fastened to a patient's waist and neck respectively. The actuator includes a DC motor to rotate a worm shaft assembly causing it to reciprocate an extension rod coupled to the rocker arm. Because only low voltage is needed to drive the DC motor, the traction device is safe in use. When not in use, the folding bed may be folded up or separated and used for sleeping.

DETAILED DESCRIPTION OF THE PREFERRED EMBODIMENTS

Figures 1A, 1B:
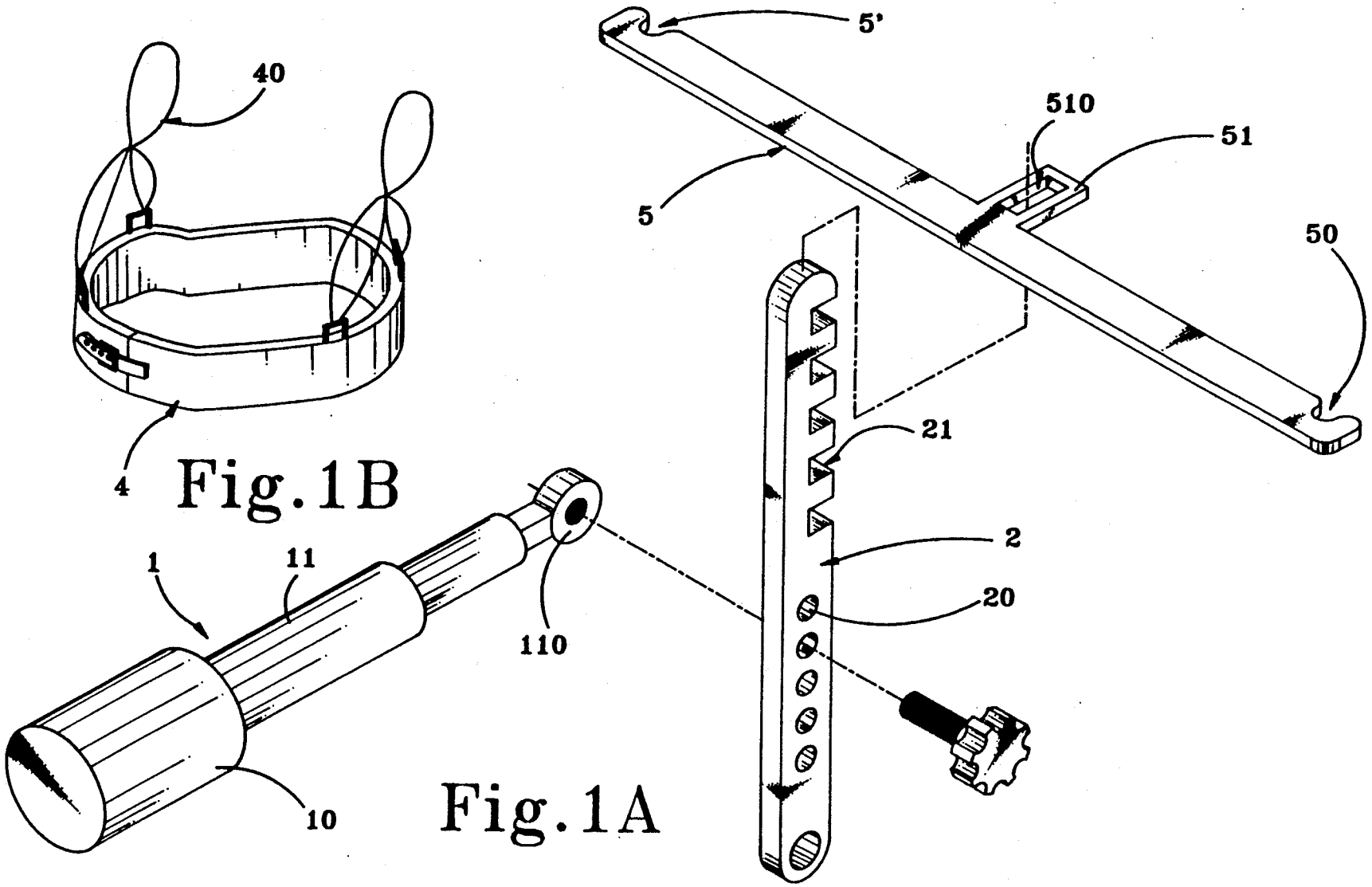
FIG. 1A is a perspective view of the waist harness.
FIG. 1B is an exploded view of the actuator, the rocker arm and the horizontal pull rod of the preferred embodiment of the traction device of the present invention.
Figure 2:
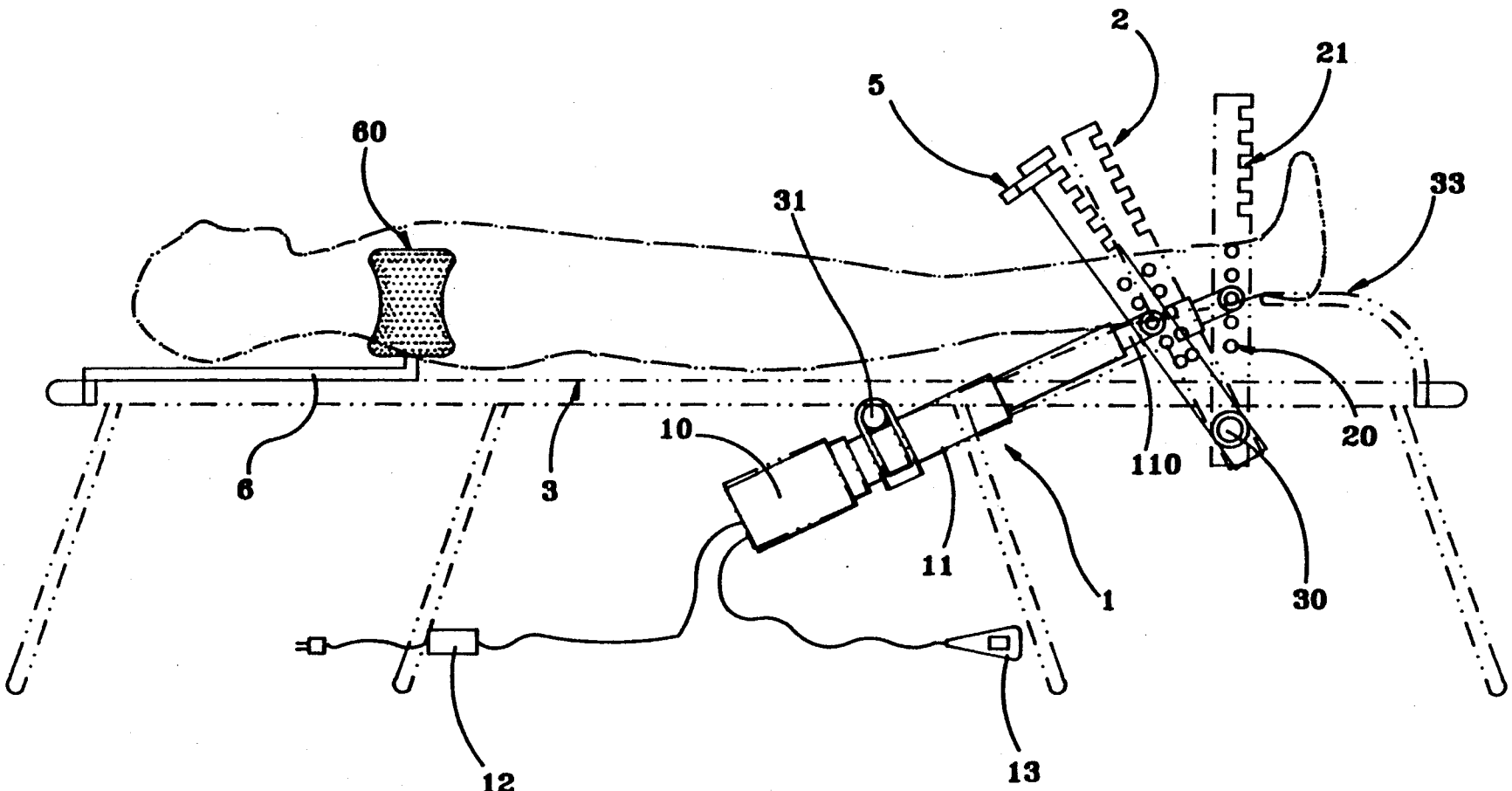
FIG. 2 is a plan side view of the traction device according to the present invention in which the harness for the neck is not installed.

Referring to FIGS. 1A, 1B and 2, actuator 1 is used to provide a traction force in operating the traction device. The actuator 1 comprises a reciprocating worm shaft assembly 11 driven by a high-torque DC motor 10 to move back and forth, an AC/DC transformer 12 to provide the DC motor 10 with the necessary working current, and a controller 13 controlled to rotate the DC motor 10 clockwise or counter-clockwise. The worm shaft assembly 11 comprises a front extension rod 110 fastened to either of a row of adjustment holes 20 on the lower part of a rocker arm 2 by a screw. The rocker arm 2 has a bottom end pivoted to the middle part of a rear cross bar 30 on a folding bed 3. By connecting the front extension rod 110 of the worm shaft assembly 11 to another adjustment hole on the rocker arm 2, the moment arm is changed, and therefore the traction force is adjusted. The rocker arm 2 has a row of grooves 21 spaced on one side back to the actuator 1 over the upper part thereof for mounting a horizontal pull rod 5. The horizontal pull rod 5 has two notches 50,50′ on two opposite ends thereof for hanging the pull ropes 40 of a harness 4, and a loop 51 on the middle. By inserting the rocker arm 2 through the hole 510 on the loop 51, the loop 51 is hung on either groove 21 on the rocker arm 2, and therefore the harness 4 can be pulled by the actuator 1 through the rocker arm 2. By hanging the loop 51 on another groove on the rocker arm 2, the counter torque is changed. The aforesaid rocker arm 2, the pull rod 5 and the harness 4 form a traction mechanism.

Figure 3:
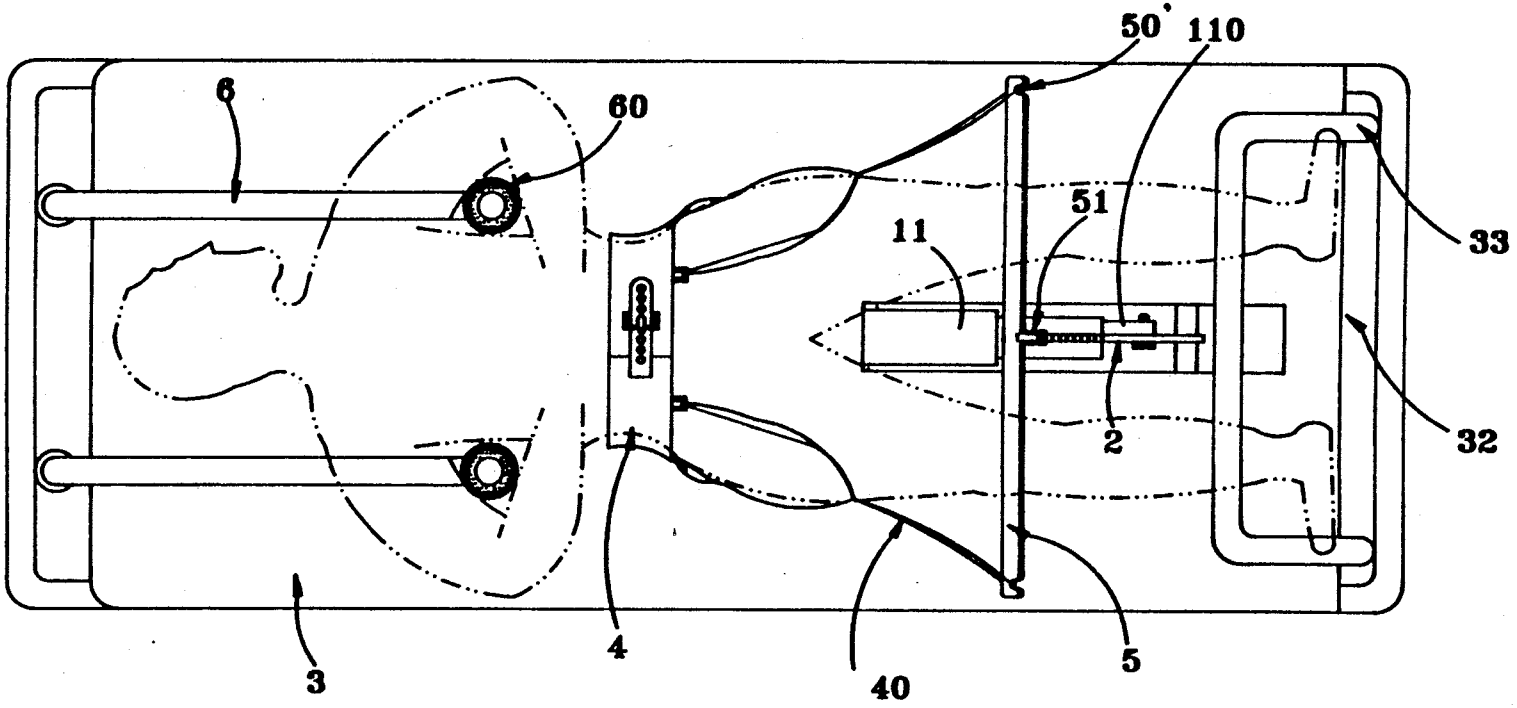
FIG. 3 is a top view of FIG. 2.
Figure 6:
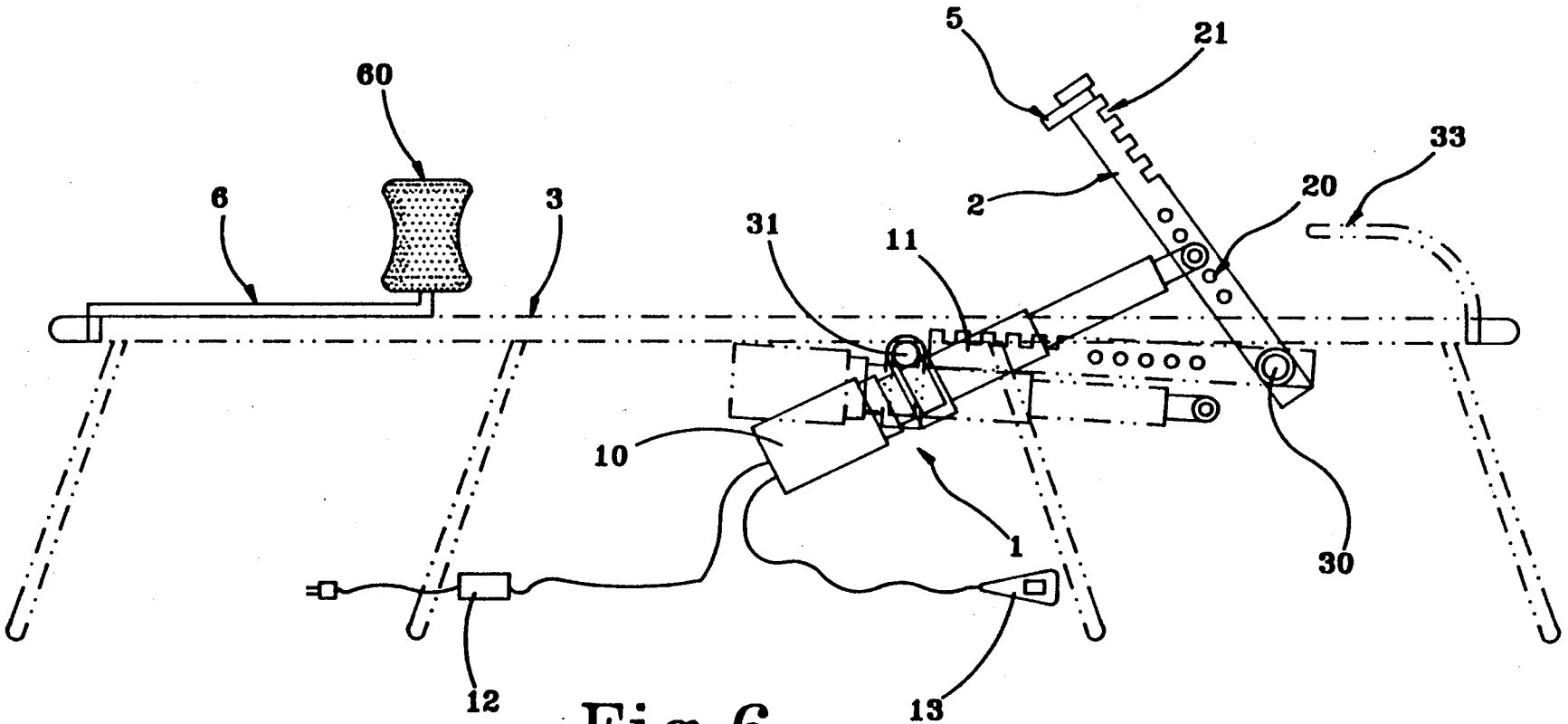
FIG. 6 is still another plan side view of the traction device according to the present invention showing that the actuator and the rocker arm can be received below the folding bed.

Referring to FIG. 3 and FIG. 2, the actuator 1 is pivoted to a middle cross bar 31 on the folding bed 3 to reciprocate the rocker arm 2. The folding bed 3 has an elongated opening 32 in longitudinal direction along the middle part adjacent to one end thereof between the legs for passing the worm shaft assembly 11 and the rocker arm 2. When not in use, the rocker arm 2 is disconnected from the front extension rod 110 of the worm shaft assembly 11 so that the rocker arm 2 and the actuator 1 can be received below the folding bed 3 (see FIG. 6). Also two elongated restraining members 6 are provided on the folding bed 3 for holding the patient in the folding bed 3 as the patient is pulled by the traction mechanism. The elongated restraining members 6 have each one end bent downwards and inserted in a respective hole (not shown) on the head of the folding bed 3 and an opposite end bent upwards and covered with a cushion 60. When in use, the cushion 60 on each elongated restraining member 6 is hooked on either armpit to hold the patient in place, and the harness 4 is fastened to the patient's waist and hung on the horizontal pull rod 5 by the pull ropes 40. After setting, the actuator 1 is controlled by the controller 13 to reciprocate the rocker arm 2 so as to apply traction to the spine of the patient.

Figure 4:
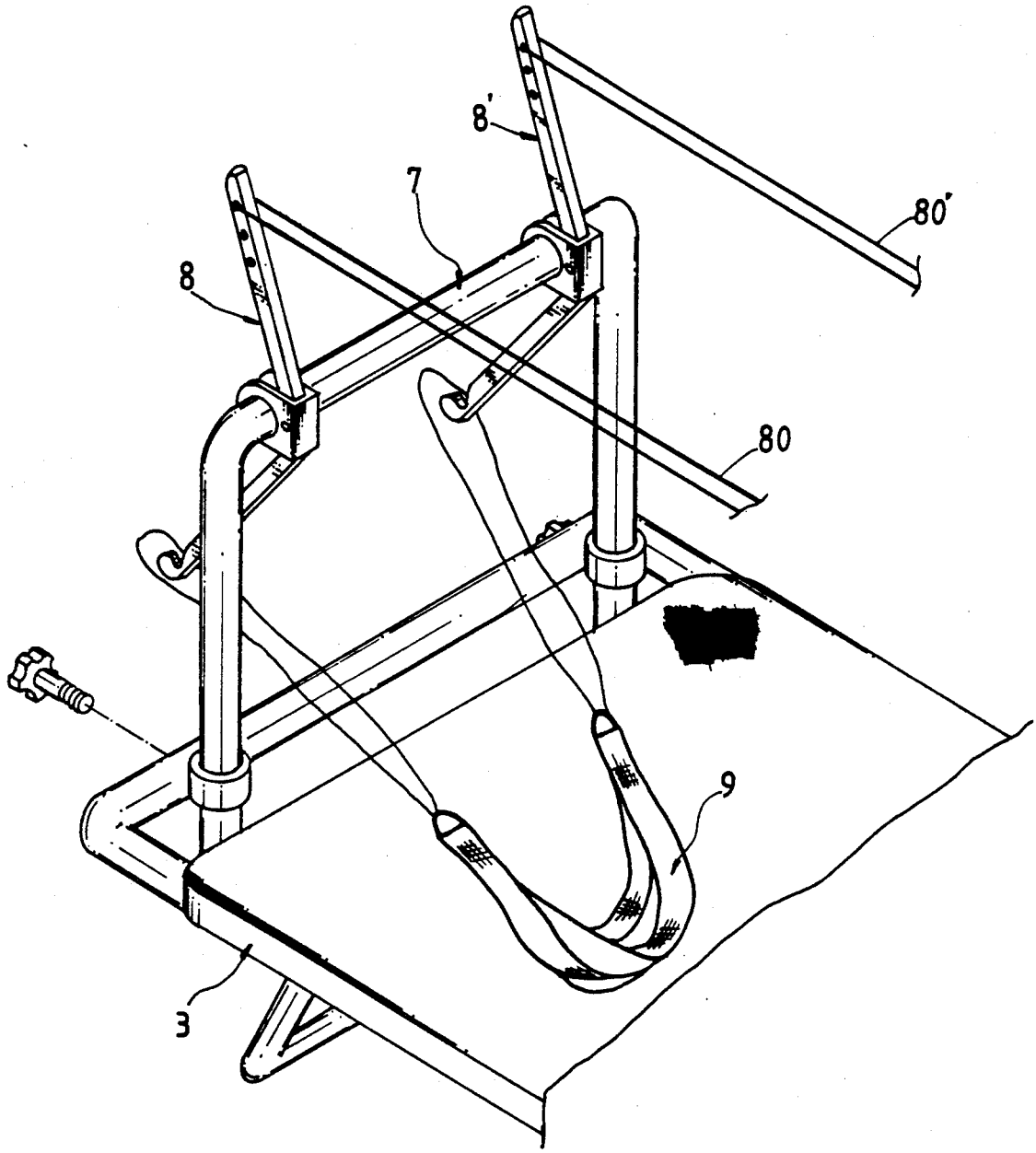
FIG. 4 illustrates the head area of the folding bed showing that two curved rod members are mounted on a gantry support to pull a harness for the neck.
Figure 5:
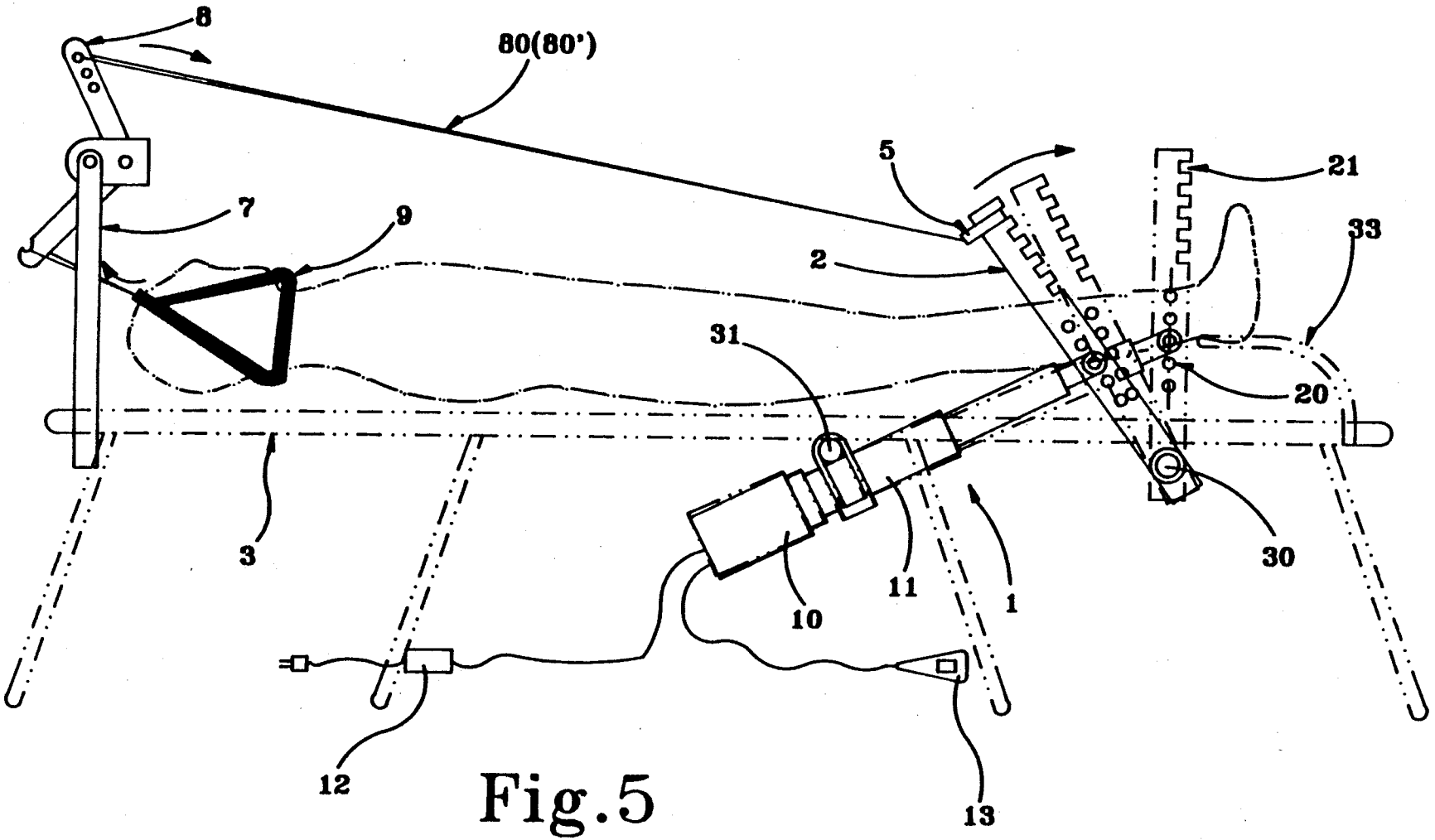
FIG. 5 is another plan side view of the traction device according to the present invention in which the harness for the neck is installed.

Referring to FIGS. 4 and 5, a gantry support 7 is fastened to the head of the folding bed 3 by tightening up screws to hold a harness 9 by two curved rod members 8,8′. The curved rod members 8,8′ are revolvably mounted on the gantry support at two opposite locations, having each a top end connected to either notch 50 or 50′ on the horizontal pull rod 5 by a respective pull rope 80 or 80′ and a bottom end connected to either end of the harness 9. Spaced holes may be made on each curved rod member 8,8' along the respective top end for fastening the respective pull rope 80 or 80', and therefore the range of oscillation of the curved rod members 8,8' on the gantry support 7 is adjusted. Furthermore, the height of the gantry support 7 on the folding bed 3 can be adjusted. This arrangement can be achieved easily by regular techniques. By fastening the harness 9 to the neck, traction is applied to the neck as the actuator 1 is turned on. And a foot rest 33 may be fastened to the rear end of the folding bed 3 on the top, on which to place the feet when lay in the folding bed 3. By means of the support of the foot rest 33 in lifting the feet, the spine is surely rested in the most suitable angle for receiving the treatment of traction.

I claim:

1. A motor-operated traction device comprising:

a folding bed for letting a patient lie in the said folding bed having two restraining members hung on the armpits to hold said patient in place, and an elongated opening disposed at a location relative to the area between the legs of said patient lying thereon;

an actuator pivoted to a middle cross bar on said folding bed, said actuator comprising a worm shaft assembly driven by a DC motor to reciprocate an extension rod through the elongated opening on said folding bed;

a rocker arm driven to swing back and forth by said actuator, said rocker arm having a bottom end pivoted to a rear cross bar on said folding bed spaced from said middle cross bar, a row of holes in longitudinal direction, to which said extension rod of said actuator is alternatively connected, and a row of parallel grooves above said row of holes;

a horizontal pull rod having a loop on a middle part thereof hung on one of said grooves on said rocker arm and two notches on two opposite ends thereof;

a waist harness hung on the two notches on said horizontal pull rod by pull ropes and adapted to be fastened to a patient's waist and pulled by said horizontal pull rod to apply traction to said patient's waist;

a height-adjustable gantry support fastened to said folding bed at an opposite end spaced from said rocker arm to hold two curved rod members, said curved rod members revolvably mounted on said gantry support and having each a top end connected to either notch on said horizontal pull rod by a pull rope and a bottom end; and a neck harness connected to the bottom end of said curved rod members by pull ropes and adapted to be fastened to said patient's neck and pulled by said horizontal pull rod to apply traction to said patient's neck.

* * * * *